US006604986B1

(12) United States Patent
Fahnle

(10) Patent No.: US 6,604,986 B1
(45) Date of Patent: Aug. 12, 2003

(54) PROCESS AND DEVICE FOR WORKING A WORKPIECE

(75) Inventor: Oliver Wolfgang Fahnle, Den Haag (NL)

(73) Assignee: Nederlandse Organisatie Voor Toegepast-Natuurwetenschappelijk Onderzoek TNO, Delft (NL)

( * ) Notice: Subject to any disclaimer, the term of this patent is extended or adjusted under 35 U.S.C. 154(b) by 0 days.

(21) Appl. No.: 09/554,909

(22) PCT Filed: Nov. 19, 1998

(86) PCT No.: PCT/NL98/00664

§ 371 (c)(1), (2), (4) Date: Oct. 23, 2000

(87) PCT Pub. No.: WO99/26764

PCT Pub. Date: Jun. 3, 1999

(30) Foreign Application Priority Data

Nov. 20, 1997 (NL) ..... 1007589

(51) Int. Cl.[7] ..... B24C 1/00

(52) U.S. Cl. ..... 451/38; 451/40; 451/90; 451/102

(58) Field of Search ..... 451/38, 39, 40, 451/90, 102

(56) References Cited

U.S. PATENT DOCUMENTS

| | | | | |
|---|---|---|---|---|
| 3,994,097 A | | 11/1976 | Lamb | |
| 4,658,683 A | | 4/1987 | Phillips | |
| 4,738,056 A | | 4/1988 | Suzuki | |
| 4,771,659 A | * | 9/1988 | Schmolke | 451/40 |
| 5,035,090 A | * | 7/1991 | Szucs | 451/102 |
| 5,573,446 A | | 11/1996 | Dey et al. | |
| 5,700,181 A | * | 12/1997 | Hashish et al. | 451/40 |
| 5,759,086 A | * | 6/1998 | Klingel | 451/40 |

FOREIGN PATENT DOCUMENTS

| | | |
|---|---|---|
| CH | 269 264 | 10/1950 |
| DE | 39 39 420 | 7/1992 |
| DE | 43 10 470 | 1/1994 |
| DE | 44 07 271 | 9/1995 |
| EP | 0 711 633 | 5/1996 |

* cited by examiner

*Primary Examiner*—M Rachuba
(74) *Attorney, Agent, or Firm*—Young & Thompson

(57) ABSTRACT

The application relates to a process for working a workpiece, in which process an abrasive liquid is sprayed onto the workpiece, via a nozzle, at relatively low pressures which are sufficient to shape and/or polish the surface of the workpiece. The workpiece can be both shaped and polished in a single working step. Abrasive particles or polishing particles may be contained in the abrasive liquid. The pressure of the abrasive liquid lies below 50 bar, preferably below 20 bar. By arranging two nozzles in such a manner that the liquid jets intersect one another at a point, it is possible to set an accurate working depth.

17 Claims, 3 Drawing Sheets

PROCESS AND DEVICE FOR WORKING A WORKPIECE

Figure 1:
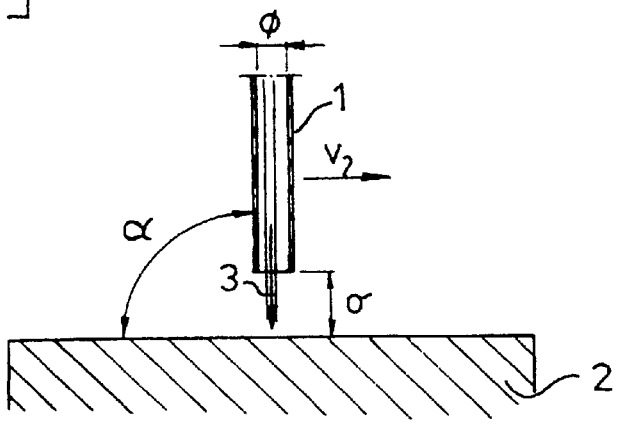

The invention relates to a process and to a device for working a workpiece wherein an abrasive liquid is sprayed onto the workpiece, via at least two nozzles, each of which is disposed at an angle with respect to the workpiece and the liquid jets from which intersect one another on or below the workpiece surface, such as for example for shaping or polishing optical components.

It is known to form curved optical surfaces in optical materials, such as quartz or glass, by means of grinding and polishing. In a three-component process of this nature, a tool, such as a mould, is used to press abrasive particles in a slurry onto the optical surface which is to be worked. The tool is subjected to load and is moved with respect to the workpiece. Although the known process makes it possible to accurately work the optical components, it is relatively lengthy. Furthermore, more complex shapes, such as aspherical optical components, cannot easily be formed using the known method.

A process and device according the preamble of claim 1 is known from DE-A-4407271. In this patent application a process is described for the working of surfaces at pressures ranging from 600–4000 bar. The high pressure used in the known process results in a relatively large roughness of the worked surface, such that the known process will not be suitable for shaping or production of for instance an optical component.

Therefore, one object of the present invention is to provide a process and device with which a workpiece can be shaped, ground or polished accurately and quickly. A further object of the present invention is to provide a process and device of this nature with which it is easy to impart complex shapes to a workpiece, in particular to optical components made of a refractive optical material, such as quartz, glass or plastic, or of a reflective optical material, such as metals and ceramic materials. Yet another object of the present invention is to provide a process and device which allow the surface to be shaped in a single operation and to be polished with the desired level of accuracy, for example to a roughness of 1 nanometre RMS or better.

To this end, the process according to the invention is characterized in that the abrasive liquid is sprayed onto the workpiece at a pressure of less than 50 bar, preferably of less than 20 bar, to shape and/or polish the surface of the workpiece. "Abrasive liquid" is in this context intended to mean a liquid which can be used to grind a surface to a relatively high roughness or to polish it to a lower roughness.

Surprisingly, it has been found that the abrasive liquid provides very controlled working of the surface of the workpiece at relatively low pressures, such as 50 bar or lower. The abrasive liquid, which preferably contains abrasive particles, has a low velocity at these low pressures, so that material is removed in a controlled manner without forming irregular pitting in the surface.

At the point where the liquid jets cross or intersect one another, the impulse of the abrasive particles or polishing particles is reduced to such an extent that no further material is removed below this point. In this way it is possible to set the working depth very accurately.

It has been found that the process according to the present invention makes it possible, when the abrasive liquid used is water containing silicon carbide particles with a size of approx. 20 $\mu$m as the abrasive, to polish a surface of BK7 to an ultimate roughness of 1.5 nm RMS. A conventional polishing method with a particle size of this nature results in a roughness of approx. 5 $\mu$m.

It should be noted that a device for cutting glass using a high-speed jet of liquid is known per se from American patent U.S. Pat. No. 4,787,178. However, the nozzle pressures which are used for cutting the glass are in the order of magnitude of 2000 bar. For this reason, the method is unsuitable for very accurate surface-working operations.

It is also known from American patent U.S. Pat. No. 5,573,446 to shape optical components by moving a stream of gas which contains abrasive particles over the surface of the workpiece in a raster pattern. This shaping process only provides limited accuracy, so that an optical component has to be polished separately after it has been shaped.

The process according to the present invention differs from the above methods by the fact that material is removed in a very controlled manner, making it possible, within a short time, both to shape the workpiece and to polish it until the desired roughness is reached.

The abrasive liquid according to the present invention may comprise a number of liquids, such as water or an organic liquid, such as octanol. Preferably, abrasive particles or polishing particles are added to an abrasive liquid, such as for example #800 silicon carbide or particles which have similar properties. Other suitable abrasive particles comprise diamond or aluminiun oxide, while diamond or cerium oxide can be used for polishing. The rate at which material is removed from the surface of the workpiece depends on the concentration, dimensions and hardness of the abrasive particles and on the type of abrasive liquid, the velocity of the abrasive liquid when it leaves the nozzle, the contact time, the geometry, the relative dimensions and orientation of the nozzle with respect to the workpiece surface, and the like. The abrasive-liquid pressures employed are preferably less than 50 bar, such as for example 5 bar. The diameter of the nozzle is preferably small compared to the dimensions of the workpiece, such as between 10 cm and 0.1 mm, preferably between 1 cm and 0.5 mm, and particularly preferably between 5 mm and 0.5 mm. The diameter of the workpiece may, for example, amount to 100 mm.

The operation is relatively insensitive to the distance between nozzle and workpiece.

Although the process according to the invention can be used on a multiplicity of materials, the method is particularly suitable for refractive optical materials, such as for example silicon, glass, sapphire, quartz, optical plastics, but also for reflective optical materials, such as metal or ceramic materials. Owing to the low energy of the abrasive liquid and the abrasive particles, material is removed gradually without pitting or scratches being formed. During the operation, one nozzle may be moved with respect to the workpiece, for example in a raster pattern. It is also possible to employ a series of nozzles and to rotate the workpiece about its axis of rotation at the same time. By linking the movement of the nozzle to the movement of the workpiece, it is possible to grind and polish complex geometric shapes, such as for example toric surfaces. By moving the axis of rotation of the workpiece it is possible, for example, to shape and polish a toric surface. The cross section of the nozzle may be circular, elliptical, triangular or rectangular, or may be in the form of a series of ellipses or rectangles in order to form a plurality of slots in a single production run, for example in order to form binary optical elements.

Figure 2A:
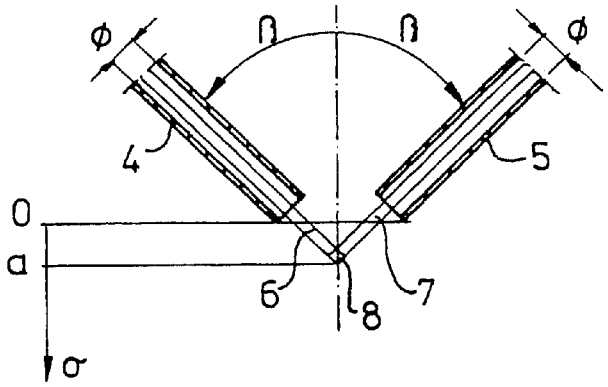
Figure 2B:
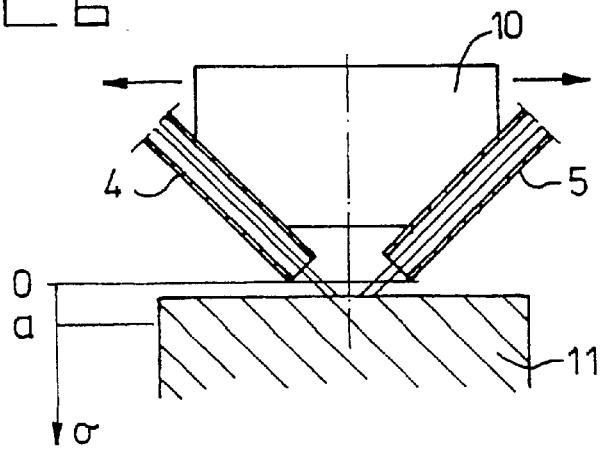
Figure 2C:
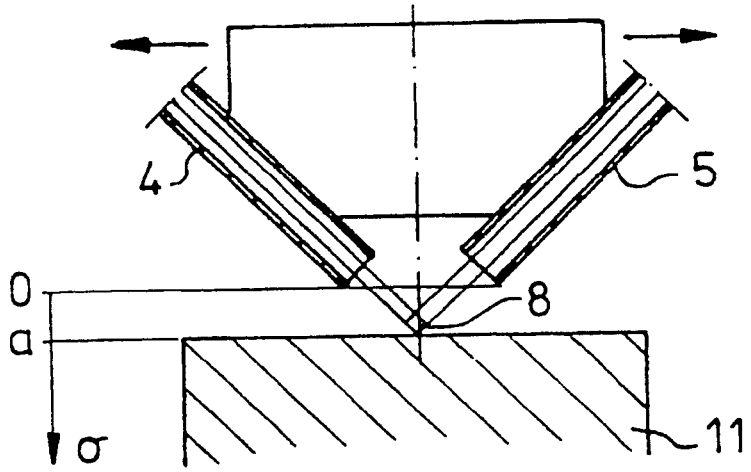
Figure 3:
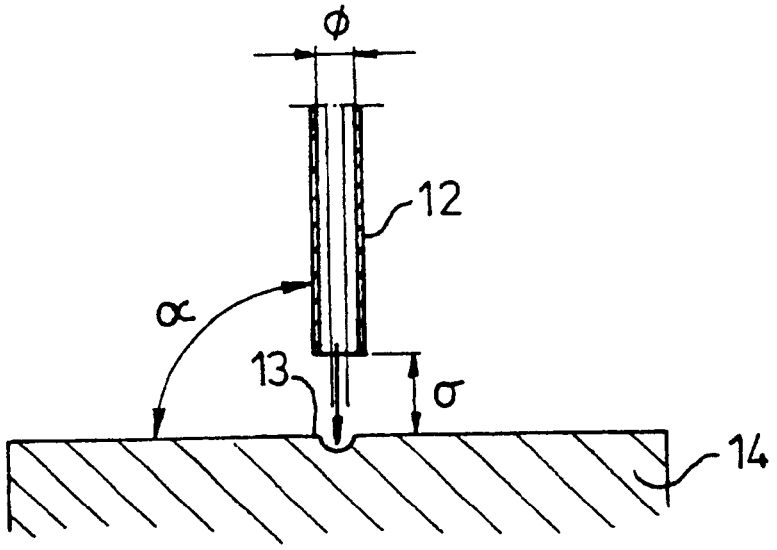
Figure 4:
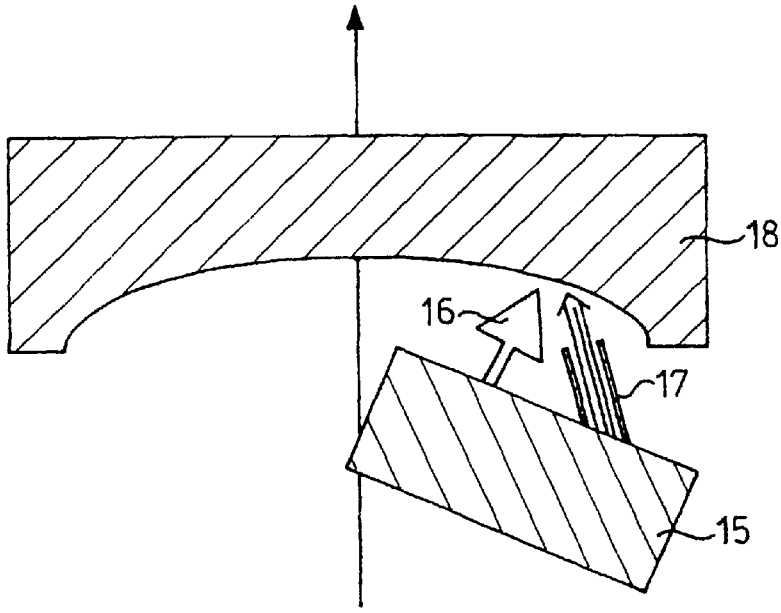
Figure 5:
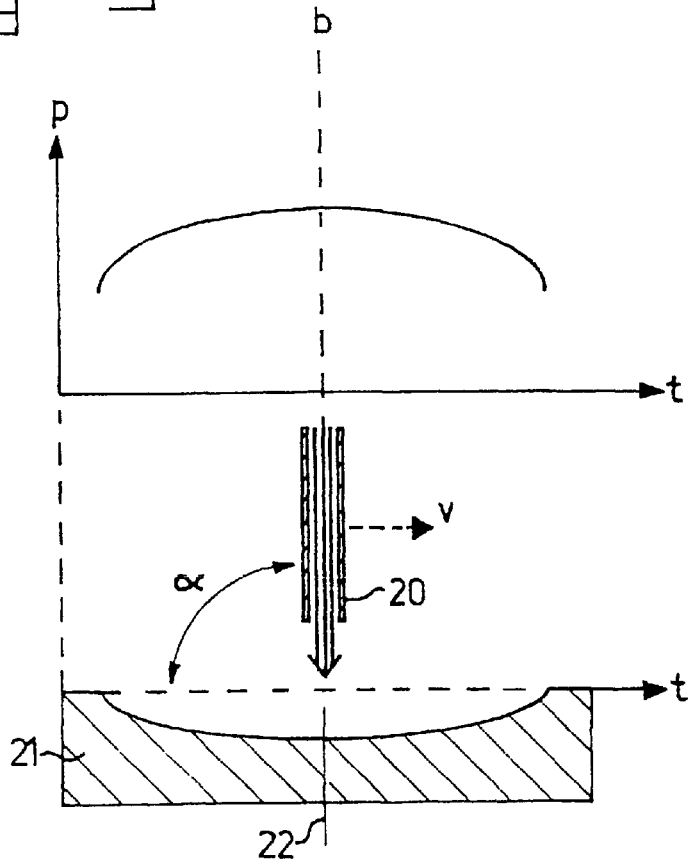

A number of aspects of the process and device according to the present invention will be explained in more detail with reference to the appended drawing, in which:

FIG. 1 shows a diagrammatic side view of a nozzle and a workpiece for use in the process according to the present invention, FIGS. 2*a* to 2*c* show diagrammatic views of a pair of nozzles with intersecting liquid jets, FIG. 3 shows a method according to the present invention for forming microtexturing in a material, FIG. 4 shows a headstock of a lathe with an integrated tool and nozzle, and FIG. 5 shows a method of shaping a rotationally symmetrical surface by means of pressure variations from a nozzle according to the invention.

As shown in FIG. 1, a nozzle 1 is moved to a distance σ above a workpiece 2. In this case, the distance σ is a few millimetres, such as for example 3 mm. The abrasive liquid 3 is sprayed onto the workpiece 2 at a pressure of, for example, 5 bar. The abrasive liquid 3 used is water containing #800 SiC abrasive particles. The diameter Φ is, for example, 2 mm. In the exemplary embodiment shown, the angle a between the nozzle 1 and the workpiece surface is 90°, and the nozzle 1 is advanced with respect to the surface of the workpiece 2 in the direction of the arrow and at a velocity V. At the relatively low pressure and the given diameter of the nozzle 1, the flow of the abrasive liquid 3 will be laminar. The rate and level of fineness of the working can be adjusted by varying diameter Φ of the nozzle, the pressure of the abrasive liquid 3, the angle α with respect to the workpiece, the distance ó between the nozzle 3 and the workpiece 2 and the velocity V.

A test was carried out using a polishing abrasive containing relatively coarse SiC particles with a dimension of approx. 22 μm in water at a concentration of 10%. The polishing abrasive was guided, via a nozzle of circular cross section with a diameter of between 0.2 and 1.6 mm, towards an optical surface made from planar BK7 glass at pressures of between 0.5 and 6 bar. The surface roughness of the optical surface was reduced from 350 nm RMS to 25 nm RMS. It was also possible to use the grinding means to form a polished surface with a surface roughness of 1.6 nm RMS without bringing about an increase in the surface roughness. It was found that no polishing or grinding effect was observed at pressures of below 1 bar. During the test, the polishing abrasive was deployed in a closed circuit in which used polishing abrasive was reused after filtering.

FIG. 2 shows an arrangement in which two nozzles 4, 5 are disposed at an angle β between the nozzle and the normal to the surface, so that the liquid jets 6, 7 intersect one another at a point 8. At this point 8, the impulse of the liquid jets and the abrasive particles will be reduced to such an extent that no material is removed below the level of plane a of the point 8. This makes it possible to accurately set the depth to which material is removed. FIG. 2*b* shows a device in which the two nozzles 4 and 5 are attached to a head 10 of a machining device. The material will be removed from the workpiece 11 to a depth a which corresponds to the intersection point 8 of the liquid jets 4 and 5 as shown in FIG. 2*c*. The advantage of the device according to the present invention lies in a very accurately defined working depth and a very low level of wear to the tool, and also in the fact that the liquid jets from the nozzles 4 and 5 clean and cool the workpiece during operation. The device described in FIG. 2 can be used to form aspherical optical components as described in International Patent Application PCT/N196/00343 in the name of the applicant. This device can also be used in a lathe or a precision-grinding machine to replace the diamond head or the diamond wheel.

FIG. 3 shows how a nozzle 12 according to the present invention can be used to form a micro-optical component 13 in a workpiece 14. The micro-optical component may, for example, comprise a parabolic mirror. The shape depends on the geometry of the nozzle, the angle α, the velocity of the abrasive liquid and the velocity with respect to the workpiece surface. Furthermore, the process and the device according to the present invention may be used to provide optical components with an identifying mark by forming small, concave polished points having a depth in the order of a few nanometres. These identifying marks will only be visible against dark field illumination and can be used for aligning the optical components.

FIG. 4 shows a headstock 15 of a milling cutter, lathe or precision-grinding machine with a diamond tool 16 and a nozzle 17 for forming an aspherical surface in a workpiece 18. Firstly, the tool 16 can be used to form the desired surface shape, after which, in a subsequent or in the same working step, this surface can be polished using the nozzle 17.

FIG. 5 shows how a nozzle 20 is moved in the direction of the arrow and at a velocity V over a workpiece 21 which is rotated about axis of rotation 22. During the movement of the nozzle 20, the pressure P of the abrasive varies in a controlled manner in accordance with the profile indicated in the figure, so that the desired surface shape is obtained. It is also possible to vary the speed of displacement V of the nozzle.

What is claimed is:

1. Process for working a workpiece, wherein an abrasive liquid is sprayed onto a workpiece, via at least two nozzles, each of which is disposed at an angle with respect to the workpiece and liquid jets from which intersect one another on or below the workpiece surface, wherein the abrasive liquid is sprayed onto the workpiece at a pressure of less than 50 bar.

2. Process according to claim 1, in which the workpiece is both shaped and polished by the abrasive liquid.

3. Process according to claim 1, wherein the abrasive liquid comprises abrasive particles or polishing particles.

4. Process according to claim 1, wherein the abrasive particles comprise #800 SiC particles.

5. Process according to claim 1, wherein the diameter of the nozzle is between 10 cm and 0.1 mm.

6. Process according to claim 1, wherein the material which is to be worked comprises one of an optical material, quartz, metal and a ceramic material.

7. Process according to claim 1, wherein the nozzle is moved with respect to the workpiece.

8. Process according to claim 7 wherein movement of the nozzle with respect to the workpiece comprises rotating the workpiece.

9. Process according to claim 7 wherein the movement comprises displacing the nozzle.

10. Process according to claim 9, wherein the nozzle is moved in a raster pattern, parallel to the workpiece.

11. Process according to claim 1, wherein at least two mutually connected nozzles are used.

12. Device for working materials, comprising at least two nozzles which are positioned in such a manner with respect to one another that the liquid jets from the nozzles intersect one another at a point, a feed line which is connected to the nozzle and contains a pump for feeding an abrasive liquid to the nozzle, wherein the pressure of the feed pump is less than 100 bar.

13. The process of claim 1, wherein the abrasive liquid is sprayed onto the workpiece at a pressure of less than 20 bar.

14. The process of claim 12, wherein the pressure of the feed pump is less than 20 bar.

15. The process of claim 5, wherein the diameter of the nozzle is between 2 cm and 0.5 mm.

16. The process of claim 15, wherein the diameter of the nozzle is between 2 mm and 0.5 mm.

17. The process of claim 4 wherein the abrasive particles have properties similar to properties of SiC particle.

* * * * *